United States Patent [19]

Horton et al.

[11] Patent Number: 4,550,764

[45] Date of Patent: Nov. 5, 1985

[54] APPARATUS AND METHOD FOR CASTING SINGLE CRYSTAL ARTICLES

[75] Inventors: Robert A. Horton, Chesterland; Gowri S. Jayaraman, Cleveland Heights, both of Ohio

[73] Assignee: TRW Inc., Cleveland, Ohio

[21] Appl. No.: 564,299

[22] Filed: Dec. 22, 1983

[51] Int. Cl.[4] ..... B22D 27/04

[52] U.S. Cl. ..... 164/122.2; 164/361

[58] Field of Search ..... 164/122.1, 122.2, 361

[56] References Cited

U.S. PATENT DOCUMENTS 3,572,419 3/1971 Barrow et al. .

3,738,416 6/1973 Kear et al. .

3,754,592 8/1973 Mullen ..... 164/122.1

*Primary Examiner*—Kuang Y. Lin

*Attorney, Agent, or Firm*—Yount & Tarolli

[57] ABSTRACT

An apparatus for casting doubly-oriented single crystal airfoils and similar articles includes a mold having an orientation selector which selects crystals having desired vertical and horizontal orientations. The orientation selector includes an upright primary growth passage having a lower end exposed to the upper side surface of a chill plate. A horizontal secondary growth passage is connected with the upper end of the primary growth passage and with the mold cavity. A gradient inducing passage is connected with the upper end of the primary growth passage and has a lower end exposed to the chill plate to promote the transmission of heat from the upper end of the primary growth passage to the chill plate after metal crystals have solidified in the gradient inducing growth passage.

15 Claims, 6 Drawing Figures

APPARATUS AND METHOD FOR CASTING SINGLE CRYSTAL ARTICLES

BACKGROUND OF THE INVENTION

The present invention relates to a new and improved apparatus and method for casting single crystal articles, such as airfoils.

It has been suggested that single crystal airfoils may be cast in many different ways, including using a single crystal selector in the manner disclosed in U.S. Pat. No. 3,542,120. Each of the single crystal selectors disclosed in this patent has an upwardly and sidewardly sloping growth passage with a lower end portion exposed to a chill plate and an upper end portion connected with a mold cavity. Exposure of the lower end portion of the growth passage to the chill plate promotes the growth of crystals which are most favorably oriented for growth in an upward direction. This results in the more favorably oriented crystals crowding out the less favorably oriented crystals during solidification of molten metal in the growth passage.

The crystal selector disclosed in the aforementioned U.S. Pat. No. 3,542,120 is used to cast a single crystal article having a cubic unit cell with a vertically oriented axis. The horizontal or <010> axes of the cubic unit cells are randomly oriented. It has been found that it is highly desirable to control the secondary or horizontal orientation of the cubic unit cells of a single crystal article in order to maximize the properties of the article.

It has been suggested that a pair of chill plates could be used to obtain a doubly-oriented single crystal casting, that is a casting having cubic unit cells with both vertical and horizontal axes in a preselected orientation relative to a central axis of the casting. Thus, U.S. Pat. No. 3,572,419 discloses an apparatus for casting doubly-oriented single crystal airfoils by using two separate chill plates, that is, a first chill plate having a horizontal major side surface and a second chill plate having a vertical major side surface.

Although the apparatus disclosed in the aforementioned U.S. Pat. No. 3,572,419 may be suitable for producing doubly-oriented single crystal castings in a laboratory, the apparatus disclosed in this patent has not been used to make doubly-oriented single crystal castings on a commercial basis. It is believed that this is because it is extremely difficult to obtain fluid tight seals between a mold and both a horizontal chill plate and a vertical chill plate. In addition, the use of a pair of chill plates requires a more elaborate furnace set-up and more complicated patterns and molds. The combination of these factors increases the cost of a doubly-oriented single crystal casting over a conventional single crystal casting having only a preselected vertical orientation.

SUMMARY OF THE PRESENT INVENTION

The present invention provides a new and improved method and apparatus for casting doubly-oriented single crystal articles with only one chill plate. The use of a single chill plate simplifies the obtaining of a fluid tight seal between the mold and the chill plate. This results in fewer runouts of molten metal and improved production.

The apparatus includes a crystal orientation selector having an upwardly extending primary growth passage. A lower end portion of the primary growth passage is exposed to the upper surface of the chill plate to promote the growth of favorably oriented metal crystals in an upward direction. A secondary growth passage extends sidewardly from the upper end of the primary growth passage to an outlet leading to the mold cavity.

In order to promote the growth of most favorably oriented crystals along the secondary growth passage, a gradient inducing passage has an upper end connected with the upper end of the primary growth passage and a lower end exposed to the chill plate. This results in the crystals which emerge from the secondary growth passage being most favorably oriented for growth in a vertical direction and most favorably oriented for growth in a sideways direction. A crystal which is most favorably oriented for growth vertically and in a selected sideways direction will have <100> and <010> axes which are in preselected orientations so that the crystal is doubly-oriented.

Accordingly, it is an object of this invention is to provide a new and improved apparatus and method for casting doubly-oriented single crystal article with only a single chill plate.

Another object of this invention to provide a new and improved apparatus and method for use in casting a doubly-oriented single crystal article in a mold cavity and wherein crystals most favorably oriented for growth in a vertical direction enter a secondary growth passage where a gradient inducing growth passage promotes the growth of metal crystals which are most favorably oriented for growth in a direction toward an outlet from the secondary growth passage.

BRIEF DESCRIPTION OF THE DRAWINGS

The foregoing and other objects and features of the present invention will become more apparent upon a consideration of the following description taken in conjunction with the accompanying drawings, wherein.

DESCRIPTION OF SPECIFIC PREFERRED EMBODIMENTS OF THE INVENTION

General Description

Figure 1:
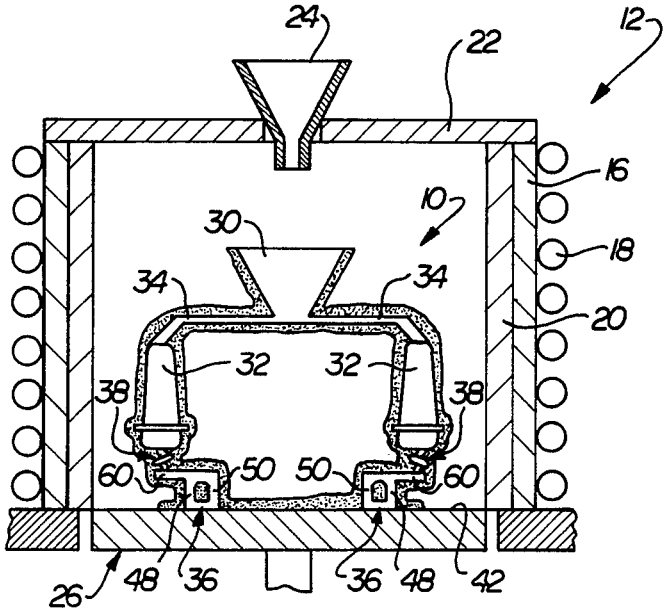
FIG. 1 is a schematic illustration depicting the manner in which a mold constructed in accordance with the present invention is supported on a chill plate in a furnace assembly prior to pouring molten metal into the mold.

A mold 10 constructed in accordance with the present invention is preheated in a furnace assembly 12 prior to pouring of molten metal into the mold. The furnace assembly 12 is provided with a cylindrical refractory outer wall 16 which is surrounded by an induction heating coil 18. A cylindrical graphite susceptor 20 is enclosed by the outer wall 16 and is heated by the effect of a magnetic field from the coil 18.

The furnace assembly 12 has a circular top plate 22 with a funnel 24 through which molten metal is poured into the mold 10. The mold 10 is supported on a chill plate 26 which is movable vertically downwardly to withdraw the mold from the susceptor chamber after the mold has been filled with molten metal. The mold 10 includes a pouring basin 30 which is connected with a plurality of airfoil mold cavities 32 by runners 34.

In accordance with a feature of the present invention, associated with each of the mold cavities 32 is a crystal orientation selector 36. Each crystal orientation selector 36 allows only doubly-oriented crystals to grow into a single crystal selector 38. Each of the single crystal selectors 38 extends between an upper end of a crystal orientation selector 36 and the lower end of a mold cavity 32.

During casting of a doubly-oriented single crystal airfoil in the mold cavity 32, only crystals having preselected vertical or <100> and horizontal <010> orientations grow from an orientation selector 36 into a single crystal selector 38. The single crystal selector 38 allows only a single crystal to enter a mold cavity 32. Thus, only one doubly-oriented crystal having a desired horizontal and vertical orientation enters each of the airfoil mold cavities 32 from the single crystal selectors 38. This results in the solidification in the mold cavity 32 of a single crystal airfoil having cubic unit cells with a preselected vertical and horizontal orientation.

The single crystal selectors 38 are of the helical or pigtail type disclosed in U.S. Pat. Nos. 4,111,252 and 3,712,368. However, it is contemplated that other types of single crystal selectors could be used if desired. In fact, the single crystal selectors 38 could be eliminated if only a single crystal emerged from each of the crystal orientation selectors 36.

When doubly-oriented single crystal airfoils are to be cast in the mold cavity 32, the entire mold, including the crystal orientation selectors 36, single crystal selectors 38 and mold cavities 32, is filled with molten metal. The molten metal is a nickel-chrome super alloy similar to the alloys disclosed in U.S. Pat. No. 3,260,505. The single chill plate 36 is cooled so that a large number of randomly oriented crystals are nucleated as the molten metal solidifies against a horizontal upper side surface 42 of the chill plate. The chill plate 26 is then lowered, in a known manner, to withdraw the mold 10 from the furnace assembly 12.

As the chill plate 26 and mold 10 are lowered, the crystal orientation selectors 36 cooperate with the chill plate to allow only crystals having a predetermined vertical or <100> orientation and a predetermined horizontal or <010> orientation to grow into the single crystal selectors 38. This is accomplished by using the single chill plate 26 to establish both vertical and horizontal temperature gradients. The vertical temperature gradient is used to promote the growth of crystals which are most favorably oriented for growth in a vertical direction with a resultng crowding out or retarding of the growth of crystals which are less favorably oriented for growth in the vertical direction. The horizontal temperature gradient is used to promote the growth of crystals which are most favorably oriented for growth in a selected horizontal direction with a resulting crowding out or retarding of the growth of crystals which are less favorably oriented for growth in the selected horizontal direction.

The crystal orientation selectors 36 are effective to establish both horizontal and vertical temperature gradients with only a single chill plate 26. Using only a single chill plate 26 to establish both horizontal and vertical temperature gradients results in fewer mold sealing problems than would be encountered if a pair of chill plates were used to establish the horizontal and vertical temperature gradients. In addition, the use of a single chill plate 26 to establish both the horizontal and vertical temperature gradients simplifies the construction of the furnace assembly 12 and the mold 10.

Figure 2:
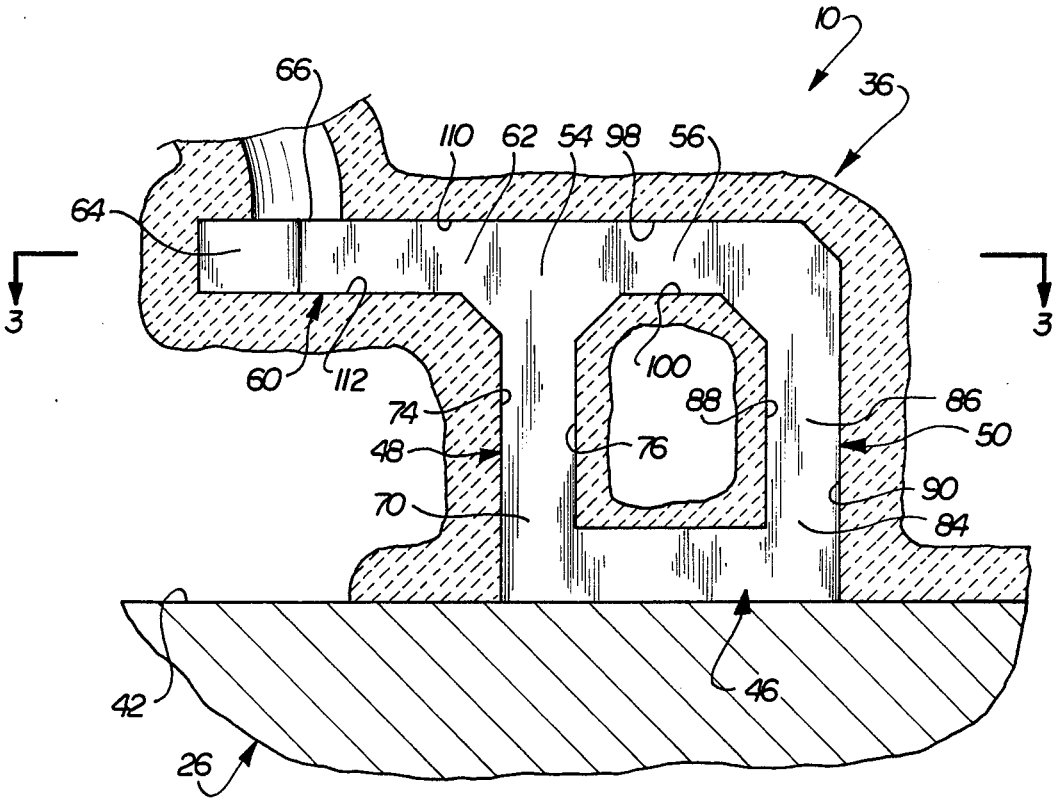
FIG. 2 is an enlarged fragmentary sectional view of a crystal orientation selector which forms a portion of the mold of FIG. 1.
Figure 3:
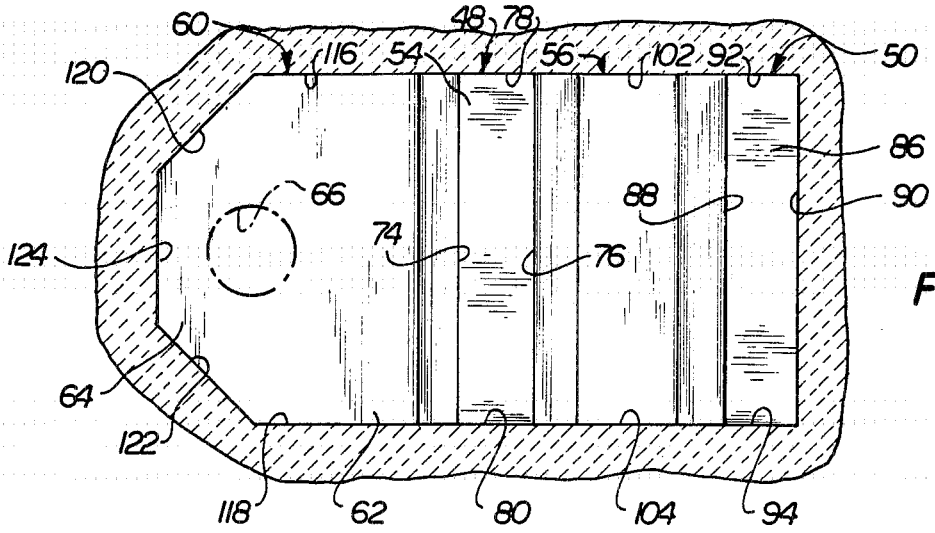
FIG. 3 is a plan view, taken generally along the line 3—3 of FIG. 2, further illustrating the construction of the crystal orientation selector.

Crystal Orientation Selector—Embodiment of FIGS. 2 and 3

When doubly-oriented single crystal airfoils are to be cast in the mold cavity 32, the mold 10 is filled with molten metal. Thus, the molten metal flows downwardly from the basin 30 through the runners 34, mold cavities 32, and single crystal selectors 38 into the crystal orientation selectors 36. The molten metal in each crystal orientation selector 36 (see FIG. 2) enters a starter cavity 46 and engages the horizontal upper side surface 42 of the chill plate 26. It should be undertood that the molten metal could be poured directly against the upper side surface 42 of the chill plate or against layers of foil (not shown) disposed between the upper side surface 42 of the chill plate and the bottom of the mold 10.

The chill plate 26 establishes a strong vertical temperature gradient. Therefore the crystals which have a most favorable vertical or <100> orientation grow upwardly from the chill plate 26 through the starter cavity 46 (FIG. 2) into a primary growth passage 48 and a gradient inducing growth passage 50. An upper end portion 54 of the primary growth passage 48 is connected with an upper end portion 56 of the gradient inducing growth passage 50. Therefore, when the crystals have reached the upper end portions 54 and 56 of the primary growth passage 48 and gradient inducing growth passage 50, heat is transmitted back to the chill plate 26 through the crystals in both the primary growth passage 48 and the gradient inducing growth passage 50.

When the crystals which are most favorably oriented for growth in a vertical or <100> direction have reached the upper end portion of the primary growth passage 48 and/or gradient inducing growth passage 50, they grow sidewardly into a horizontally extending secondary growth passage 60. The right or entry end portion 62 of the secondary growth passage 60 is connected with the upper end portions 54 and 56 of the primary and gradient inducing growth passages 48 and 50. The left or outlet end portion 64 of the secondary growth passage 60 is connected with a circular outlet or opening 66 (FIGS. 2 and 3) leading to a single crystal selector 38 and mold cavity 32 (FIG. 1).

Since heat is conducted to the chill plate 26 through the gradient inducing growth passage 50 (FIG. 2), a horizontal temperature gradient is established across the secondary growth passage 60 as crystals begin to grow into the secondary growth passage. This temperature gradient results in the crystals which are most favorably oriented for growth in a horizontal or <010> direction crowding out the crystals which are less favorably oriented for growth in a leftward (as viewed in FIG. 2) horizontal direction. Therefore, only doubly-oriented crystals, that is crystals which are most favorably oriented for vertical and sideward growth reach the outlet opening 66 at the end of the secondary growth passage 60.

Only doubly-oriented crystals having cubic unit cells with a vertical Z-axis and a horizontal X-axis extending parallel to the longitudinal central axis of the secondary growth passage 60 reach a single crystal selector 38. Therefore, only doubly-oriented crystals grow from the single crystal selector 38 into a mold cavity 32. This results in a doubly-oriented single crystal casting having cubic unit cells of the same orientation as the unit cells of the crystal or crystals growing into the single crystal selector 38.

The primary growth passage 48 (FIG. 2) has a lower end portion 70 which is disposed above and opens downwardly toward a horizontal upper side surface 42 of the chill plate 26. This results in crystals nucleated in the starter cavity 46 growing upwardly into the vertical primary growth passage 48. The vertical primary growth passage 48 has a generally rectangular cross sectional configuration as viewed in a horizontal plane (FIG. 3). Thus, primary growth passage 48 has a pair of wide vertical side surfaces 74 and 76 which provide the growth passage with a relatively wide dimension. In addition, the primary growth passage 48 has a pair of narrow vertical side surfaces 78 and 80 (FIG. 3) which extend perpendicular to the side surfaces 74 and 76 and form a relatively narrow dimension of the primary growth passage.

The gradient inducing growth passage 50 has an open lower end portion 84 (FIG. 2) which is disposed above and opens downwardly toward upper major open side surface 42 of the chill plate 26. The gradient inducing growth passage 50 has a vertical main section 86 which extends parallel to the primary growth passage 48.

The vertical main section 86 of the gradient inducing growth passage 50 has a generally rectangular cross sectional configuration when viewed in a horizontal plane (FIG. 3). Thus, the gradient inducing growth passage 50 has a pair of wide vertical side walls 88 and 90 which form a relatively wide dimension, as viewed in FIG. 3, of the gradient inducing growth passage. In addition, the gradient inducing growth passage 50 has a pair of narrow vertical side walls 92 and 94 which extend perpendicular to the side walls 88 and 90 from a narrow dimension of the rectangular gradient inducing growth passage 50 (FIG. 3). The side walls 92 and 94 are disposed in a coplanar relationship with the sidewalls 78 and 80 of the primary growth passage 48 and are of the same size as the side walls 78 and 80 of the primary growth passage.

The horizontal upper portion 56 of the gradient inducing growth passage 50 has a generally rectangular cross sectional configuration, as viewed in a vertical plane. Thus, the upper end portion 56 of the primary growth passage 50 has a pair of wide horizontal side surfaces 98 and 100 (FIG. 2) which are interconnected by a pair of narrow vertical side surfaces 102 and 104 (FIG. 3). The upper end portion 56 of the gradient inducing growth passage 50 is disposed on the same level as the secondary growth passage 60 and has the same height and width as the entry end portion 62 of the secondary growth passage 60.

The horizontal secondary growth passage 60 has a generally rectangular cross sectional configuration as viewed in a vertical plane through the entry end portion 62 of the secondary growth passage. The cross sectional configuration of the entry end portion 62 of the secondary growth passage 60 in a vertical plane is the same as the cross sectional configuration of the upper end portion 56 of the gradient inducing growth passage 50 in a vertical plane. The secondary growth passage 60 has a horizontal upper side surface 100 which is formed as a continuation of the horizontal upper side surface 98 of the gradient inducing growth passage 50. In addition, the secondary growth passage 60 has a horizontal lower side surface 112 which is formed as a continuation of the side surface 100 of the gradient inducing growth passage 50.

The secondary growth passage 60 has a generally rectangular cross sectional configuration when viewed in a vertical plane. The secondary growth passage 60 is relatively wide throughout its length until it reaches the outlet end portion 64. Thus, parallel vertical side surfaces 116 and 118 (FIG. 3) are formed as continuations of the side surfaces 102 and 104 of the gradient inducing growth passage 50 and define the width of the secondary growth passage 60. Since the distance between the sidewalls 116 and 118 is the same as the distance between the side walls 78 and 80 of the primary growth passage 48, the entry end portion 62 of the secondary growth passage 60 is as wide as the upper end portion 54 of the primary growth passage 48. At the outlet end portion 64 of the secondary growth passage 60, a pair of vertical side walls 120 and 122 taper inwardly at the vertical end wall 124 the length of the secondary growth passage 60 is substantially the same as the height of the primary passage 48.

The crystal orientation selector 36 is positioned in the furnace assembly 12 (FIG. 1) with the primary growth passage 48 closer to the susceptor wall 20 than the gradient inducing growth passage 50. Although applicants are not certain, it is theorized that this orientation of the crystal orientation selector 36 may result in the molten metal in the gradient inducing growth passage 50 cooling at a slightly greater rate than the molten metal in the primary growth passage 48 as the chill plate 26 is withdrawn from the furnace assembly 12. This would result in crystals in the gradient inducing growth passage 50 reaching the upper end portion 54 of the primary growth passage 48 at the same time as crystals in the primary growth passage 48. However, it is believed that in certain instances, the crystals in the primary growth passage 48 may reach the upper end portion 54 of the primary growth passage before the crystals in the gradient inducing growth passage 50 have grown sidewardly throughout the length horizontal end portion 56 of the gradient inducing growth passage. In either case, it is believed that the crystals which grow into the secondary growth passage 60 originate in the primary growth passage 48. However under certain circumstances, it may be possible for a crystal having a particularly favored orientation to grow from the gradient inducing growth passage 50 across the upper end portion 54 of the primary growth passage 48 into the secondary growth passage 60.

Figure 4:
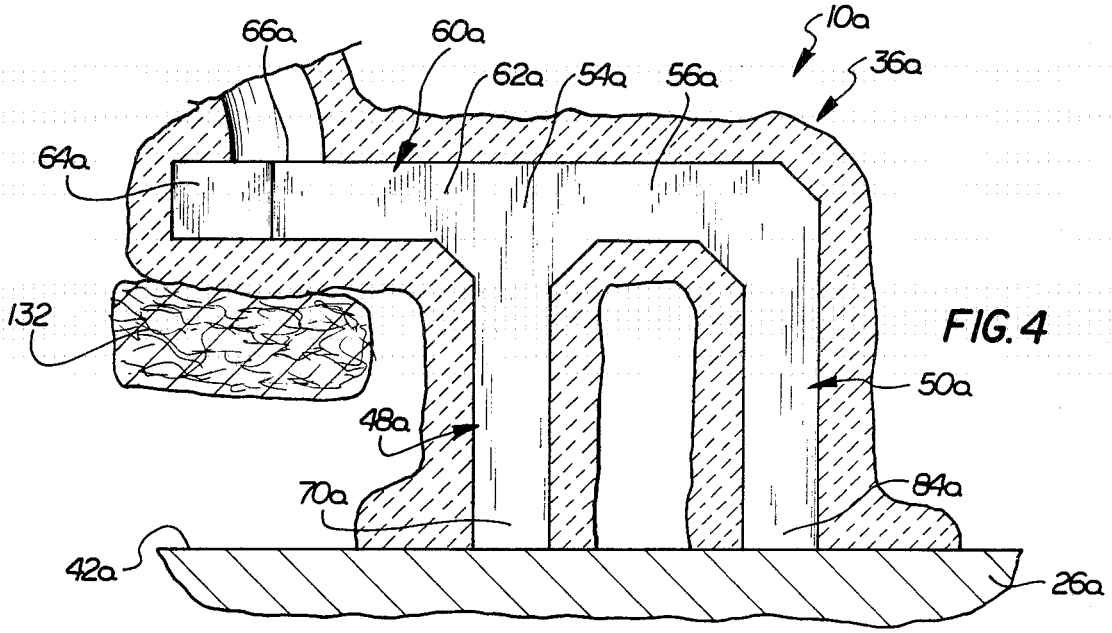
FIG. 4 is a fragmentary sectional view, generally similar to FIG. 2, of a second embodiment of the crystal orientation selector.

Crystal Orientation Selector—Embodiment of FIG. 4

The embodiment of the invention shown in FIG. 4 is generally similar to the embodiment of the invention shown in FIGS. 2 and 3. However, the embodiment of the invention shown in FIG. 4 does not initiate nucleation of the crystals in a starter cavity 46. Since the embodiment of the invention shown in FIG. 4 is generally similar to the embodiment of the invention shown in FIGS. 2 and 3, similar numerals will be used to designate similar components, the suffix letter "a" being associated with the numerals of FIG. 4 in order to avoid confusion.

A mold 10*a* includes a crystal orientation selector 36*a* which is supported on a chill plate 26*a* having a horizontal upper side surface 42*a*. The orientation selector 36*a* includes a vertical primary growth passage 48*a* and a gradient inducing growth passage 50*a*. The primary growth passage 48*a* has an upper end portion 54*a* which is connected with an upper end portion 56*a* of the gradient inducing growth passage 50*a*. A secondary growth passage 60*a* has an entry end portion 62*a* which is connected with the upper end portion 54*a* of the primary growth passage 48*a* and an outlet end portion 64*a* which is connected with a single crystal selector and mold cavity through a circular opening 66*a*.

In accordance with a feature of this embodiment of the invention, the primary growth passage 48*a* has an open lower end portion 70*a* which is blocked by the upper side surface 42*a* of the chill plate 26*a*. Similarly, the gradient inducing growth passage 50*a* has a lower end portion 84*a* which is also blocked by the upper side surface 42*a* of the chill plate 26*a*.

In the embodiment of the invention illustrated in FIG. 4, a body of insulation 132 is disposed between the upper side surface 42*a* of the chill plate 26*a* and the secondary growth passage 60*a*. The body of insulation 132 blocks the radiation of heat downwardly from the portion of the mold which is partially defined as a secondary growth passage 60*a* to the chill plate 26*a*. It is theorized that the presence of the body of insulation 132 retards the spurious nucleation of crystals in the secondary growth passage 60*a* and allows crystals to grow from the primary growth passage 48*a* and/or the gradient inducing growth passage 50*a* into the secondary growth passage 60*a*. Although it is believed that it may be possible for a most favorably oriented crystal to grow from the gradient inducing section 50*a* into the secondary growth passage 60*a*, it is believed that crystals which grow into the secondary growth passage 60 will probably originate in the primary growth passage 48*a*.

During solidification of the molten metal in the secondary growth passage 60*a*, the solidified metal crystals in the gradient inducing growth passage 50*a* provide a heat transmittal path to the chill plate 26*a*. This results in the setting up of a horizontal temperature gradient across the secondary growth passage 60 to promote the horizontal growth of the most favorably oriented crystals toward the left (as viewed in FIG. 4) along a path extending parallel to the horizontal central axis of the secondary growth passage 60*a*.

Figure 5:
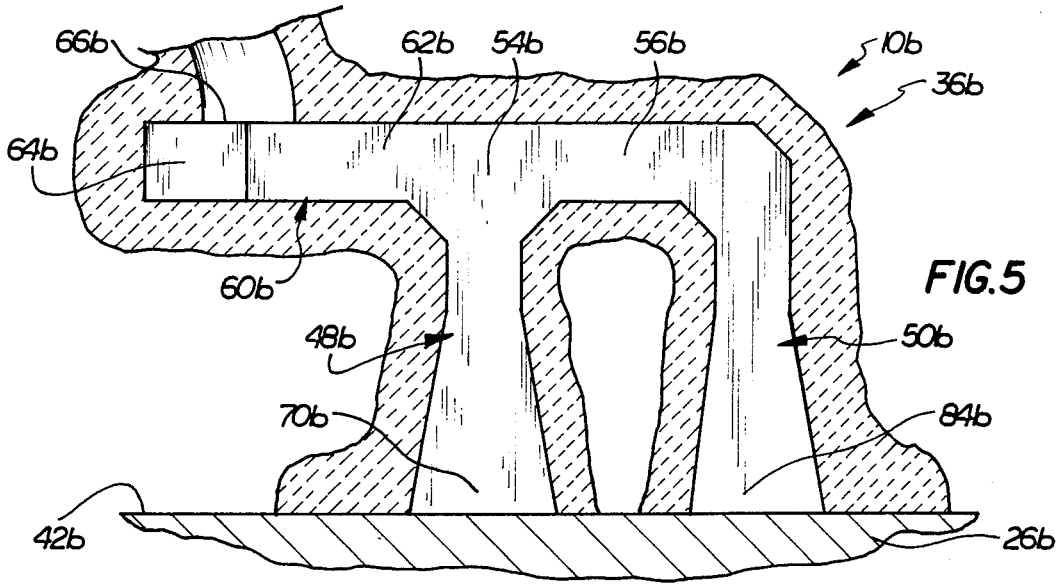
FIG. 5 is a fragmentary sectional view, generally similar to FIGS. 2 and 4, illustrating the construction of another embodiment of the crystal orientation selector.

Crystal Orientation Selector—Embodiment of FIG. 5

The crystal orientation selector shown in FIG. 5 is of the same general construction as the crystal orientation selector shown in FIGS. 2 and 3. However, the crystal orientation selector shown in FIG. 5 has a pair of separate starter cavities rather than a single starter cavity. Since the embodiment of the invention shown in FIG. 5 is generally similar to the embodiment of the invention shown in FIGS. 2 and 3, similar numerals will be utilized to designate similar components, the suffix letter "b" being associated with the embodiment of FIG. 5 to avoid confusion.

A mold 10*b* includes a crystal orientation selector 36*b* which is disposed on a horizontal upper side surface 42*b* of a chill plate 26*b*. The crystal orientation selector 36*b* includes a vertical primary growth passage 48*b* and a secondary growth passage 50*b*. The primary growth passage 48*b* has an upper end portion 54*b* which is connected with a horizontal upper end portion 56*b* of the gradient inducing growth passage 50*b*. A secondary growth passage 60*b* has an entry or right end portion 62*b* which is connected with the upper end portion 54*b* of the primary growth passage 48*b*. The secondary growth passage 60*b* has a left or outlet end portion 64*b* and a circular opening 66*b* leading to a single crystal selector and a mold cavity.

In the embodiment of the invention shown in FIG. 5, the lower end portion 70*b* of the primary growth passage 48*b* flares sidewardly outwardly to provide an enlarged cross sectional area where molten metal engages the upper side surface 42*b* of the chill plate 26*b*. The flaring lower end portion 70*b* of the primary growth passage 48*b* enables a relatively large number, compared to the embodiment of the invention shown in FIG. 4, of crystals to be nucleated at the lower end portion 70*b* of the primary growth passage 48*b*. Similarly, the gradient inducing growth passage 50*b* has a sidewardly flaring lower end portion 84*b* which is blocked by the upper side surface of the chill plate 26*b*.

Figure 6:
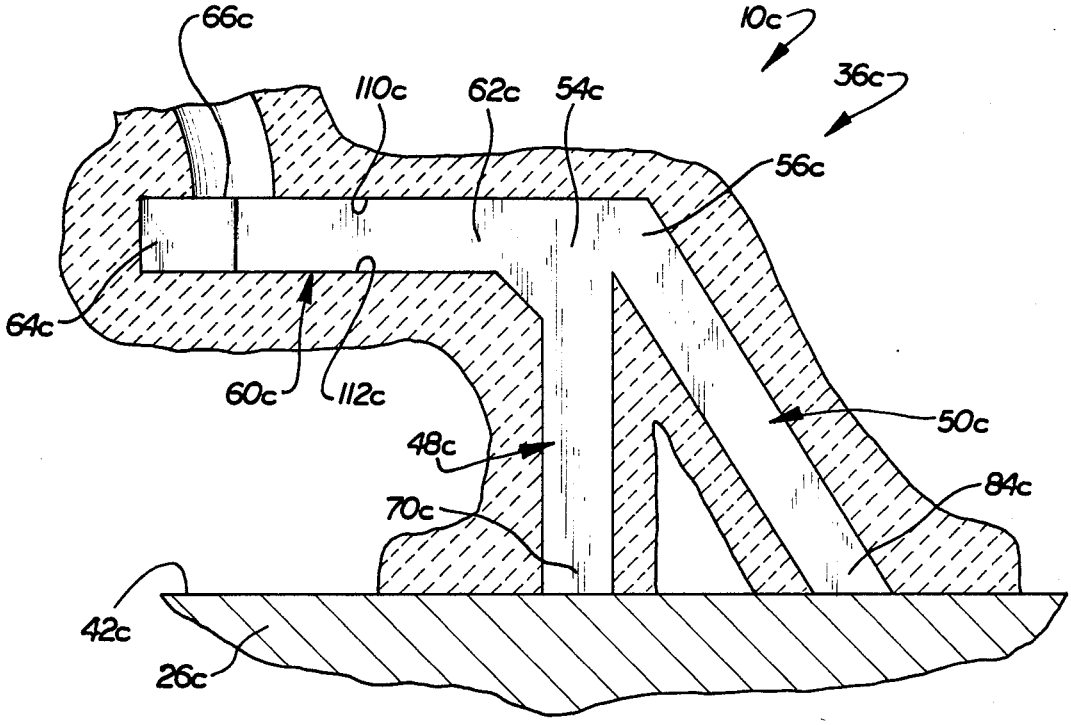
FIG. 6 is a fragmentary sectional view, generally similar to FIG. 2, illustrating the construction of a crystal orientation selector in which a gradient inducing growth passage extends upwardly from a chill plate at an acute angle.

Crystal Orientation Selector—Embodiment of FIG. 6

In the embodiment of the crystal orientation selector shown in FIG. 2, the gradient inducing growth passage 50 has a horizontal upper end portion 56 which is connected with the upper end portion 54 of the primary growth passage 48. Crystals growing in the primary growth passage 48 must only grow vertically upwardly to reach the end portion 54 of the primary growth passage. Crystals growing in the gradient inducing growth passage 50 must grow vertically upwardly through the same distance as the crystals in the primary growth passage 48. In addition, the crytals in the gradient inducing growth pasage 50 must grow sidewardly along the horizontally extending upper end portion 56 of the gradient inducing growth passage to reach the upper end portion of the primary growth passage 48.

Due to the greater overall length of the gradient inducing growth passage 50, a small body of molten metal may be present in the upper end portion 56 of the gradient inducing growth passage 50 when crystals in the primary growth passage 48 reach the upper end portion 54 of the passage. The presence of a small body of molten metal in the upper portion 56 of the gradient inducing growth passage 50 retards the transfer of heat from the secondary growth passage 60 through the gradient inducing growth passage 50 to the chill plate 26. Of course this is detrimental to the setting up of a horizontal temperature gradient across the secondary growth passage 60.

In the embodiment of the invention shown in FIG. 6, the horizontal upper portion of the gradient inducing growth passage 50 is eliminated or at least minimized. This enables crystals growing in the gradient inducing growth passage to reach the upper end portion of the primary growth passage at the same time as crystals growing in the primary growth passage. The embodiment of the invention shown in FIG. 6 is generally similar to the embodiment of the invention shown in FIGS. 2 and 3. Therefore, similar numerals will be utilized to designate similar components, the suffix letter "c" being associated with the embodiment of the invention shown in FIG. 6 to avoid confusion.

A mold 10c includes a crystal orientation selector 36c which is disposed on a chill plate 26c having an upper side surface 42c. The crystal orientation selector 36c includes a vertically extending primary growth passage 48c and a gradient inducing growth passage 50c. The primary growth passage 48c has an upper end portion 54c which is connected with an upper end portion 56c of the gradient inducing growth passage 50c. A secondary growth passsage 60c extends horizontally leftwardly (as viewed in FIG. 6) from the upper end portion 54c of the primary growth passage 48c. The secondary growth passage 60c has an inlet end portion 62c and an outlet end portion 64c. The outlet end portion 64c is connected with a single crystal selector and a mold cavity through an opening 66c.

The primary growth passage 48c has a lower end portion 70c which is blocked by the upper side surface 42c of the chill plate 26c. Similarly, the gradient inducing growth passage 50c has a lower end portion 84c which is also blocked by the upper side surface 42c of the chill plate 26c.

In accordance with a feature of this embodiment of the invention, the gradient inducing growth passage 50c slopes upwardly and sidewardly at an acute angle to the horizontal upper side surface 42c of the chill plate 26c to the upper end portion 54c of the primary growth passage 48c. This results in crystals growing in the gradient inducing growth passage 50c reaching the upper end portion 54c of the primary growth passage 48c at the same time as crystals growing in the primary growth passage 48c. The gradient inducing passage 50c is longer than the primary growth passage 48c. This is because the primary growth passage 48c extends straight upwardly to the connection between the upper end portions 54c and 56c of the primary growth passage and gradient inducing growth passage 50c. The gradient inducing growth passage 50c slopes upwardly and sidewardly to the interconnection between the two growth passages. However, the same rate of vertical growth of crystals is obtained in the primary growth passage 48c and gradient inducing growth passage 50c by equalizing the rate of heat transfer from the primary and gradient inducing growth passages.

As the chill plate 26c moves vertically downwardly out of the furnace assembly, the crystals grow vertically upwardly in the primary growth passage 48c and the gradient inducing growth passage 50c at the same vertical growth rate. Thus, the crystals in the passages 48c and 50c grow upwardly from the horizontal side surface 42c of the chill plate 26c at the same rate measured along a vertical axis as the mold 10c is withdrawn from the furnace assembly. Therefore, even though the crystals in the gradient inducing passage 50c are growing both upwardly and sidewardly, they grow upwardly at the same rate as the crystals in the primary growth passage 48c. This results in the crystals in the primary growth passage 48c and the gradient inducing growth passage 50c reaching the interconnection between the two passages at the same time.

Since the crystals in the upwardly sloping gradient inducing passage 50c reach the upper end portion 54c of the primary growth passage 48c at the same time as crystals in the primary growth passage 48c, there is an immediate path for the transfer of heat from the secondary growth passage 60c to the chill plate 26c through the gradient inducing growth passage 50c. Although the gradient inducing passage 50c slopes upwardly and sidewardly to the upper end portion 54c of the primary growth passage 48c and the entrance to the secondary growth passage 60c, a generally horizontal temperature gradient is set up in the secondary growth passage 60c to promote the horizontal growth of more favorably oriented crystals from the primary growth passage 48c and/or from the gradient inducing growth passage 50c into the secondary growth passage 60c. This is because the upper end portion 56c of the gradient inducing growth passage 50c is directly connected with the inlet 62c to the secondary growth passage 60c.

The primary growth passage 48c and gradient inducing growth passage 50c both have rectangular cross sectional configurations when viewed in a horizontal plane. The width of the primary growth passage 48c is the same as the width of the gradient inducing growth passage 50c and width of the primary growth passage 60c.

The secondary growth passage 60c has a rectangular cross sectional configuration throughout its length, as viewed in vertical planes extending perpendicular to a longitudinal central axis of the secondary growth passage 60c. Thus, the secondary growth passage 60c has a pair of parallel vertical side walls which extend between horizontal top and bottom surfaces 110c and 112c and correspond to the side walls 116 and 118 of FIG. 3.

The embodiment of the invention shown in FIGS. 2 and 3 of the crystal orientation selector 36 has a gradient inducing growth passage 50 with a substantially uniform cross section throughout its length. Thus, the upper end portion 56 of the gradient inducing growth passage 50 has the same cross sectional area as the vertical main section 86 of the gradient inducing growth passage. It is contemplated that the vertical main section of the gradient inducing growth passage could have a relatively wide thin configuration and the horizontal upper portion of the gradient inducing growth passage could have a generally square configuration. Thus, a crystal orientation selector has been built with a gradient inducing growth passage having a vertical height of approximately 1-3/16 inches, a thickness of approximately $\frac{1}{8}$ of an inch and a width of approximately 1 inch. The horizontal upper portion of the gradient inducing growth passage was square in cross sectional configuration and had a side dimension of approximately 5/16 of an inch. In this embodiment of the invention the secondary growth passage had a generally square cross sectional configuration with a side dimension of 5/16 of an inch. The primary growth passage had an outwardly flaring lower end portion similar to the configuration of the lower end portion 70b of the embodiment of the invention shown in FIG. 5 and a circular upper end portion with a diameter of approximately 5/16 of an inch.

In the foregoing description, various theories have been set forth for the manner in which the crystal orientation selectors 36, 36a, 36b and 36c control crystal growth to provide doubly-oriented cyrstals which result in the formation of a doubly-oriented single crystal article in the mold cavity 32. Although, at the present time, it is believed that these theories are correct, it should be understood that the theories may, in some respects at least, be incorrect. However, it has been established that the crystal orientation selectors of FIGS. 2–6 can be used to make doubly-oriented single crystal castings. At the present time, it is preferred to use the crystal selector 36. However, the other crystal selectors could be used if desired.

SUMMARY

In view of the foregoing description it is apparent that the present invention provides a new and improved method and apparatus for casting doubly-oriented single crystal articles with only one chill plate. The use of a single chill plate 26 simplifies the obtaining of a fluid tight seal between the mold 10 and the chill plate. This results in fewer runouts of molten metal and improved production.

The apparatus includes a crystal orientation selector 36 having an upwardly extending primary growth passage 48. A lower end portion 70 of the primary growth passage is exposed to the upper surface 42 of the chill plate 26 to promote the growth of favorably oriented metal crystals in an upward direction. A secondary growth passage 60 extends sidewardly from the upper end 54 of the primary growth passage 48 to an outlet 66 leading to the mold cavity 32.

In order to promote the growth of most favorably oriented crystals along the secondary growth passage 60, a gradient inducing passage 50 has an upper end 56 connected with the upper end 54 of the primary growth passage 48 and a lower end 84 exposed to the chill plate 26. This results in the crystals which emerge from the secondary growth passage 60 being most favorably oriented for growth in a vertical direction and most favorably oriented for growth in a sideways direction.

Having described specific preferred embodiments of the invention, the following is claimed:

1. An apparatus for use in casting a doubly-oriented single crystal article in a mold cavity, said apparatus comprising a chill plate having an upper side surface, primary growth passage means extending upwardly away from said upper side surface of said chill plate for receiving molten metal during casting of the article, said primary growth passage means having an upper end portion offset to one side of said mold cavity and a lower end portion exposed to the upper side surface of said chill plate to promote the growth of metal crystals most favorably oriented for growth in an upward direction at a rate which is greater than the growth rate of less favorably oriented crystals to enable the more favorably oriented crystals to retard the growth of the less favorably oriented crystals during solidification of the molten metal in said primary growth passage means, gradient inducing growth passage means extending upwardly away from the upper side surface of said chill plate for receiving molten metal during casting of the article, said gradient inducing growth passage means having a lower end portion exposed to the upper side surface of said chill plate and an upper end portion connected with the upper end portion of said primary growth passage means to promote the growth in said gradient inducing growth passage means of metal crystals simultaneously with the growth of metal crystals in said primary growth passage means and to promote the transmission of heat from the upper end portion of said primary growth passage means to said chill plate after solidification of metal crystals in said gradient inducing growth passage means, and secondary growth passage means for receiving molten metal during casting of the article, said secondary growth passage means extending sidewardly from the upper end portion of said primary growth passage means in a direction transverse to the direction of crystal growth in said primary growth passage means, said secondary growth passage means having a first end portion connected with the mold cavity and a second end portion connected with the upper end portions of said primary and gradient inducing growth passage means to promote the growth in said secondary growth passage means of metal crystals which are most favorably oriented for growth in a direction toward said first end portion of said secondary growth passage means at a rate which is greater than the growth rate of less favorably oriented crystals under the influence of a heat gradient which is at least partially the result of a flow of heat from said secondary growth passage means to said chill plate through said gradient inducing passage means.

2. An apparatus as set forth in claim 1 wherein said gradient inducing growth passage means includes a vertical section extending upwardly away from said chill plate and a section extending sidewardly from an upper end portion of said vertical section to the upper end portion of said primary growth passage means in the same direction as said secondary growth passage means.

3. An apparatus as set forth in claim 1 wherein said gradient inducing growth passage means slopes upwardly away from said chill plate to the upper end portion of said primary growth passage means along an axis which is skewed at an acute angle to the upper side surface of said chill plate.

4. An apparatus as set forth in claim 1 further including starter cavity means extending between lower end portions of said primary and gradient inducing growth passage means for receiving molten metal during casting of the article, said starter cavity means having a lower side surface which is defined by the upper side surface of said chill plate to promote the nucleation of metal crystals in said starter cavity means.

5. An apparatus as set forth in claim 1 further including insulation means disposed between at least a portion of said secondary growth passage and the upper side surface of said chill plate.

6. An apparatus as set forth in claim 1 wherein said apparatus further includes heater means for heating said primary, secondary and gradient inducing growth passage means, said secondary growth passage means being disposed closer to said heater means than said gradient inducing growth passage means.

7. An apparatus as set forth in claim 1 further including selector means horizontally offset to one side of said primary growth passage means and connected with said first end portion of said secondary growth passage means and the mold cavity for selecting a single crystal from a plurality of crystals entering said selector means from said secondary growth passage means.

8. An apparatus as set forth in claim 1 wherein said primary growth passage means has a generally rectangular cross sectional configuration with a-wide dimension in a first direction and a relatively narrow dimension in a second direction as viewed in a plane parallel to the upper side surface of said chill plate and extending through the upper end portion of said primary growth passage means at a location immediately beneath the connection with said gradient inducing growth passage means, said secondary growth passage means having a generally rectangular cross sectional configuration as viewed in a vertical plane, said second end portion of said secondary growth passage means having a relatively wide dimension in the first direction equal to the relatively wide dimension of said primary growth passage means and a relatively narrow dimension in a vertical direction.

9. An apparatus as set forth in claim 8 wherein said gradient inducing growth passage means has a generally rectangular cross section configruation as viewed in a vertical plane at a location adjacent to and offset to one side of the connection with said primary growth passage means, said upper end portion of said gradient inducing growth passage means having a relatively wide dimension in the first direction equal to the relatively wide dimension of said primary growth passage means.

10. A method of casting an article comprising the steps of providing a mold having a.cavity with a configuration corresponding to the configuration of an article to be cast, a secondary growth passage connected in communication with the mold cavity, a primary growth passage having an upper end portion connected with the secondary growth passage and an open lower end portion, and a gradient inducing growth passage having an upper end portion connected with the upper end portion of the primary growth passage and an open lower end portion, supporting the mold with a chill plate, said step of supporting the mold including positioning the mold with the open lower end portions of the primary and gradient inducing growth passages opening downwardly and with the upper end portions of the primary and gradient inducing growth passages disposed at the same vertical distance from an upper side surface of the chill plate, filling the mold cavity, and the primary, secondary and gradient inducing growth passages with molten metal, growing metal crystals upwardly in the primary and gradient inducing growth passages, reaching the upper end portions of the primary and gradient inducing growth passages with the upper end portions of the metal crystals, growing crystals away from the upper end portion of the primary growth passage into the secondary growth passage toward the mold cavity, and, while performing said step of growing crystals into the secondary growth passage, conducting heat from the upper end portion of the primary growth passage to the chill plate along a first path extending downwardly to the chill plate through the primary growth passage and along a second path extending downwardly to the chill plate through the gradient inducing growth passage to thereby promote the growth of crystals in the secondary growth passage.

11. A method of casting an article as set forth in claim 10 wherein said step of providing a mold includes the step of providing a mold having a gradient inducing growth passage having a central axis which is skewed at an acute angle relative to a central axis of the primary growth passage, said step of growing metal crystals upwardly in the gradient inducing growth passage including the step of growing metal crystals along a path which slopes upwardly to the upper end portion of the primary growth passage.

12. A method of casting an article as set forth in claim 10 wherein said step of providing a mold includes the step of providing a mold having a gradient inducing growth passage having a lower portion with a central axis which extends parallel to a central axis of the primary growth passage and an upper portion with a central axis which extends perpendicular to a central axis of the primary growth passage, said step of growing metal crystals upwardly in the gradient inducing growth passage including the step of growing metal crystals along a vertical path in the lower portion of the gradient inducing passage, said step of growing metal crystals upwardly in the primary growth passage including the step of growing metal crystals along a vertical path.

13. A method as set forth in claim 12 wherein said step of growing metal crystals in the gradient inducing growth passage includes the step of growing metal crystals along a horizontal path in the upper portion of the gradient inducing passage.

14. An apparatus for use in casting a single crystal article in a mold cavity, said apparatus comprising a chill plate, primary growth passage means extending upwardly away from said chill plate for receiving molten metal during casting of the article, said primary growth passage means having an upper end portion offset to one side of said mold cavity and a lower end portion exposed to said chill plate to promote the growth of metal crystals most favorably oriented for growth in an upward direction at a rate which is greater than the growth rate of less favorably oriented crystals to enable the more favorably oriented crystals to retard the growth of the less favorably oriented crystals during solidification of the molten metal in said primary growth passage means, said upper end portiion of said primary growth passage means having a relatively wide cross sectional dimension in a first direction in a horizontal plane and a relatively narrow cross sectional dimension in a second direction in the horizontal plane, gradient inducing growth passage means extending upwardly away from said chill plate and toward said mold cavity to the upper end portion of said primary growth passage means for receiving molten metal during casting of the article, said gradient inducing growth passage means having a lower end portion exposed to said chill plate and an upper end portion connected with the upper end portion of said primary growth passage means to promote the transmission of heat from the upper end portion of said primary growth passage means to said chill plate after solidification of metal crystals in said gradient inducing growth passage means, said upper end portion of said gradient inducing growth passage means having a relatively wide dimension in the first direction in a vertical plane and a relatively narrow cross sectional dimension in a vertical direction in the vertical plane, and secondary growth passage means extending from the upper end portion of said primary growth passage means toward said mold cavity for receiving molten metal during casting of the article, said secondary growth passage means having a first end portion connected with the upper end portion of said primary growth passage means and a second end portion connected with the mold cavity, said first end portion of said secondary growth passage means having a relatively wide dimension in the first direction equal to the relatively wide dimensions of said upper end portions of said primary and gradient inducing growth passage means and a relatively narrow dimension in a vertical direction, said secondary growth passage means having a pair of sidewalls which extend between the first and second end portions of said secondary growth passage means, said sidewalls being separated by a first distance equal to the relative wide dimensiion of said primary growth passage means at the first end portion of said secondary growth passage means.

15. An apparatus as set forth in claim 14 wherein said secondary growth passage means has a length which is substantially the same as the height of said primary growth passage means.

* * * * *